US008113968B2

(12) United States Patent
Fittler

(10) Patent No.: US 8,113,968 B2
(45) Date of Patent: Feb. 14, 2012

(54) SCREEN APPARATUS AND METHOD OF USE

(76) Inventor: Marshall Fittler, Goonellabah (AU)

( * ) Notice: Subject to any disclaimer, the term of this patent is extended or adjusted under 35 U.S.C. 154(b) by 0 days.

(21) Appl. No.: 12/161,495

(22) PCT Filed: Jan. 18, 2007

(86) PCT No.: PCT/AU2007/000048

§ 371 (c)(1),
(2), (4) Date: Feb. 24, 2009

(87) PCT Pub. No.: WO2007/082346

PCT Pub. Date: Jul. 26, 2007

(65) Prior Publication Data

US 2010/0227714 A1 Sep. 9, 2010

(30) Foreign Application Priority Data

Jan. 18, 2006 (AU) ..... 2006900248

(51) Int. Cl.
*A63B 69/00* (2006.01)

(52) U.S. Cl. ..... 473/446; 473/422; 473/439; 473/454; 473/476

(58) Field of Classification Search ..... 473/422, 473/434, 435, 438, 446, 471, 477, 478
See application file for complete search history.

(56) References Cited

U.S. PATENT DOCUMENTS

| | | | | |
|---|---|---|---|---|
| 1,043,308 | A | | 11/1912 | Everson |
| 1,511,430 | A | | 10/1924 | Schonberg |
| 1,527,988 | A | | 3/1925 | McMurtrie |
| 2,059,365 | A | | 11/1936 | King |
| 2,254,986 | A | | 9/1941 | Ziel |
| 2,873,969 | A | | 2/1959 | Ziel |
| 3,157,399 | A | * | 11/1964 | Gaudet ..... 473/455 |
| 3,580,578 | A | | 5/1971 | McCarthy |
| 3,791,653 | A | * | 2/1974 | Yamada ..... 473/186 |
| 3,822,883 | A | | 7/1974 | De Vos |
| 4,173,337 | A | * | 11/1979 | Okonowski ..... 473/456 |
| 4,210,326 | A | | 7/1980 | Booth et al. |
| 4,275,883 | A | * | 6/1981 | Grimaldi et al. ..... 473/432 |
| 4,437,661 | A | * | 3/1984 | Chavez ..... 473/439 |
| 4,492,380 | A | | 1/1985 | Saytar |
| 4,497,485 | A | | 2/1985 | Macosko |
| 4,657,250 | A | * | 4/1987 | Newland et al. ..... 473/432 |
| 4,718,668 | A | | 1/1988 | Schipske |
| 4,836,542 | A | | 6/1989 | Crawley |
| 4,978,121 | A | * | 12/1990 | Larkey ..... 473/454 |
| 5,037,095 | A | | 8/1991 | Nedwick |
| 5,096,191 | A | | 3/1992 | Fang |

(Continued)

FOREIGN PATENT DOCUMENTS

| | | |
|---|---|---|
| CA | 2373866 | 8/2003 |

(Continued)

*Primary Examiner* — Mitra Aryanpour
(74) *Attorney, Agent, or Firm* — Cantor Colburn LLP

(57) ABSTRACT

A screen apparatus for use in sports training or sports skills development, the screen apparatus including a plurality of screen members and a support means for supporting the screen members in a use condition, each of the screen members at least temporarily attached relative to the support means such that in use, the screen members define a screen until struck by an object at which time at least one of the screen members is at least partially dislodged to allow passage of the object in a substantially uninhibited manner.

23 Claims, 12 Drawing Sheets

U.S. PATENT DOCUMENTS

| | | | | |
|---|---|---|---|---|
| 5,156,549 | A | 10/1992 | Wehrell | |
| 5,181,725 | A * | 1/1993 | Leras et al. | 473/446 |
| 5,252,076 | A | 10/1993 | Kelleher | |
| 5,333,856 | A | 8/1994 | Gery | |
| 5,351,948 | A | 10/1994 | Thomas | |
| 5,413,533 | A * | 5/1995 | Bolus et al. | 473/55 |
| 5,573,239 | A * | 11/1996 | Ryker et al. | 473/436 |
| 5,842,938 | A * | 12/1998 | Garber | 473/430 |
| 5,863,266 | A * | 1/1999 | Starnes | 473/471 |
| 6,264,572 | B1 * | 7/2001 | Matheson et al. | 473/446 |
| 6,398,672 | B1 * | 6/2002 | Olson | 473/439 |
| 6,878,078 | B2 * | 4/2005 | Swanson | 473/454 |
| 7,762,912 | B2 * | 7/2010 | Lewis | 473/454 |
| 2006/0089212 | A1 * | 4/2006 | Marchel | 473/422 |
| 2006/0089213 | A1 * | 4/2006 | Snyder | 473/435 |
| 2009/0093325 | A1 * | 4/2009 | Meltzer et al. | 473/454 |

FOREIGN PATENT DOCUMENTS

| | | |
|---|---|---|
| DE | 2341666 | 2/1975 |
| FR | 2688143 | 9/1993 |
| GB | 381983 | 10/1932 |
| WO | 99/07447 | 2/1999 |
| WO | 2005/056127 | 6/2005 |

* cited by examiner

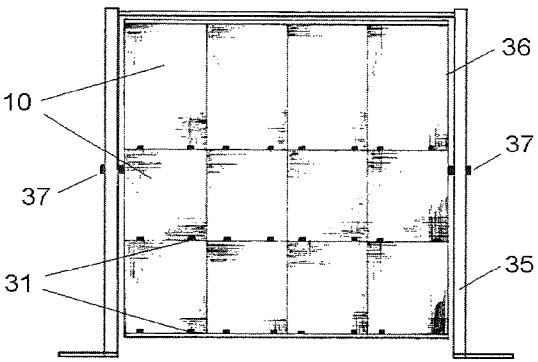
Figure 10
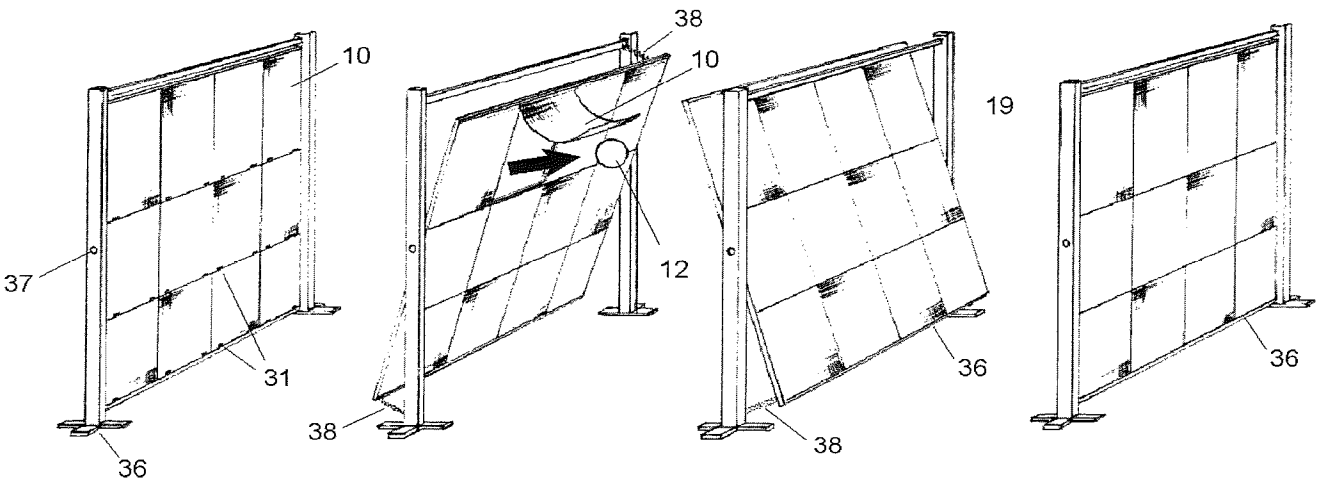
Figure 10A
Figure 10B
Figure 10C
Figure 10D

SCREEN APPARATUS AND METHOD OF USE

FIELD OF THE INVENTION

The present invention relates to screen apparatus and particularly to a screen apparatus for use in sports training or sports skills development.

BACKGROUND ART

There are many devices available in the art which are adapted to provide training for particular sports. A selection of devices are described below.

Pitching practice, golf ball targets, tennis training, football kicking practice and other ball devices are in common use. The patents, U.S. Pat. No. 1,043,308, issued Nov. 5, 1912, to A. G. Everson, and U.S. Pat. No. 5,333,856, issued Aug. 2, 1994, to J. S. Gery, are examples of these devices having pockets provided in netting. Netting has been provided with indicia for indication of ball control and simulation of actual game conditions with U.S. Pat. No. 1,511,430, issued Oct. 14, 1924, and U.S. Pat. No. 2,254,986 issued Sep. 2, 1941, to M. Ziel, examples. Adjustable target sizes have been taught in U.S. Pat. No. 5,333,856 and by U.S. Pat. No. 5,351,948, issued Oct. 4, 1994, to R. J. Thomas. Various materials can be used for the netting. Portable frames have also been used, with U.S. Pat. No. 4,718,668, issued Jan. 12, 1988, to D. Schipske and U.S. Pat. No. 4,836,542, issued Jun. 6, 1989 to M. J. Crawley, examples. It has been taught that these frames can be made of plastic and permanently or removably assembled., U.S. Pat. No. 4,836,542 and U.S. Pat. No. 5,351,948. It is known that hollow frames can be filled with water or other material for stability, U.S. Pat. No. 4,718,668.

Other examples of prior art include U.S. Pat. No. 1,527,988 (McMurtrie) that discloses a net device comprising entirely of cells and used to play a game with a golf ball. U.S. Pat. No. 3,580,578 (McCarthy) discusses a goal for a bouncing ball game. U.S. Pat. No. 4,492,380 (Saytar) discloses a goal assembly for a modified basketball and hockey game. U.S. Pat. No. 3,822,883 (De Vos) discloses a target with compartments for playing a ball game where a ball is thrown into the compartments for points. U.S. Pat. No. 4,497,485 (Mascosko) discloses a baseball pitching target. U.S. Pat. No. 5,037,095 (Nedwick) discloses a quarterback trainer apparatus. U.S. Pat. No. 5,096,191 (Fang) discloses a basketball training apparatus with hoops. None of the references, however, contains the suggestion that the device may be modified for use to improve a player's reaction time in a simulated game situation.

As it stands however, there are remarkably few devices which are capable of assisting a sportsperson or player with improving reaction time to real game situations.

It will be clearly understood that, if a prior art publication is referred to herein, this reference does not constitute an admission that the publication forms part of the common general knowledge in the art in Australia or in any other country.

SUMMARY OF THE INVENTION

The present invention is directed to a screen apparatus and method of use, which may at least partially overcome at least one of the above-mentioned disadvantages or provide the consumer with a useful or commercial choice.

In one form, the invention resides in a screen apparatus for use in sports training or sports skills development, the screen apparatus including a plurality of screen members and a support means for supporting the screen members in a use condition, each of the screen members at least temporarily attached relative to the support means such that in use, the screen members define a screen until struck by an object at which time at least one of the screen members is at least partially dislodged to allow passage of the object in a substantially uninhibited manner.

In a second form, the invention resides in a method for using a screen apparatus for sports training or sports skills development including the step of locating a screen apparatus between a trainee and an object to decrease the visibility of the object by the trainee and then propelling the object through the screen apparatus to simulate a sports situation such that the trainee has less time to react to the object.

The apparatus of the present invention is particularly adapted to sports training or skills development for sports. The apparatus is designed to improve a player's co-ordination and/or reaction time as the device is preferably used to decrease the time that a player is given to intercept (or evade) the object. It can also be used to prevent the player having an early view of the object as it travels towards the player.

Reaction time is important in many sports and day to day activities, though it is not often measured nor do athletes or sportsmen specifically train to improve reaction time. As with all sports fitness training, specificity is very important, and if a trainee were to seriously want to improve reaction time in a certain sport, the trainee needs to train in a manner more specific to the visual cues and muscle reactions that are encountered during that sport.

The apparatus of the present invention is used to improve the overall capabilities of the player, both mentally and physically and can be used for all levels of players whether professional athletes or amateur sportsmen. It can also be used to train sportsmen from a variety of different sports.

Amongst other qualities, the apparatus is directed toward two specific purposes, namely;

1. to allow a mobile object to pass through the screen at various speeds, in a virtually unimpeded manner; and/or
2. to be useable in situations where a player on a first side of the apparatus can see through the screen reasonably well but the trainee on the opposite side of the screen has difficulty seeing the person or object on the first side, in effect having a substantially "one-way" vision quality.

Each of the screen members are preferably manufactured from a light material so as not to disrupt or only minimally disrupt the passage of the object through the screen. As the object will preferably strike at least one of the screen members in order to pass the screen, the object will be affected in some manner, but the amount of disruption will preferably be minimised. According to the most preferred form, the screen member will preferably include a mesh member. The screen member may alternatively be opaque or partially opaque and partially see through to allow for user's of different standards and abilities and to allow for development of skills by increasing the difficulty level.

The mesh member will preferably be tightly meshed with openings approximately 1 mm on a side. The openings are preferably defined by members extending in a first direction and other members extending in a second direction, normally substantially perpendicularly.

The mesh member will typically be formed of plastic or fabric or similar A particularly preferred embodiment of the mesh member is one manufactured of what is conventionally termed "shade cloth". The screen members used in a screen may be of different sizes. For example, upper screen members may be smaller than lower screen members or centrally located screen members may be smaller than outlying screen members.

The mesh member will preferably make up the major surface area of each of the screen members. The mesh member will preferably be flexible but it may be rigid or semi-rigid. It is preferred that the mesh member will be stretched across a frame. The frame will generally be a surround frame. The frame may be rigid or semi-rigid. The frame, as with the screen member itself, may be of any shape but is preferably rectangular as this will allow a more geometrical arrangement with a large number of configurations. The frame will typically include a pair of side members and a top and a bottom member, each of which are preferably elongate members. The frame members may be of any cross-sectional shape and will preferably be extruded from a die. The mesh member will typically be tightly stretched across the support frame.

Alternatively, the screen members may not include a frame but simply be screen material. In this configuration, the screen members may preferably be configured as ribbons or similar suspended from an upper portion of a support frame and hanging under the influence of gravity. Suspending a plurality of ribbons across a support frame in a substantially coplanar orientation thereby forms a screen. A swivel assembly may be used to attach each of the ribbon screen members to the support member and preferably the swivel assembly biases the ribbon screens into a position whereby the full width of the ribbon screen member is presented to the users.

The mesh member due to its configuration, will generally provide the limited visibility intended from the apparatus. The limited visibility may be increased through the provision of a backing screen located behind the trainer so that the trainee player has to peer through the screen apparatus of the invention and the view is then of the backing screen.

The screen members may be of any shape. According to a particularly preferred embodiment, each screen member may be elongate and ribbon-like. Each ribbon may be at least partially rectangular or have at least one less wide portion (scalloped portion) over its length in order to provide a small amount of visibility through the screen. The scalloped portions will preferably be provided in lower difficulty level screens and become smaller as the proficiency of the users increases.

Each screen member will preferably be between approximately 0.8 m by 2.0 m but will be of any size depending on the size of the object being used to train the player. A 0.5 m×0.64 m embodiment is particularly useful as it can be used for such sports as soccer, hockey, and rugby because it suits the size of the ball used in those sports. In the ribbon screen embodiment of the present invention, each ribbon screen member may be approximately 0.1 m in width and of any height suitable for the particular sport or training drill.

The support means of the invention preferably include means to temporarily fix the screen members in a use condition such that a screen can be formed. The support means preferably include one or more ground bearing members with one or more uprights and laterally extending members. There will typically be a plurality of laterally extending members so that many screen members can be used to form the screen.

The support means may include flexible members such as ropes, strings, webbing straps or the like. Alternatively, one or more of the support members may be rigid or semi-rigid, manufactured from light but strong materials such as plastic for example. The support means used according to the invention is preferably modular so it can be packed into a small bag or similar for transport and quickly erected to form a size adjustable screen. The modularity of the support means also preferably results in the screen being adjustable in both size and configuration.

Either the support means or the screen members (or both) may be provided with attachment means (or parts thereof) to at least temporarily attach the screen members relative to the support means to form the screen. According to one preferred embodiment, the attachment means will use hook and eye fasteners such as Velcro® with a portion on the support means and the corresponding portion of the fastener on the screen member, preferably on one or more of the frame members. In order to form a more complete screen, the screen members may have attachment means to attach to one another. Other attachment means may be used such as magnetic attachment, slide guides for example. The screen members may be at least partially dislodged from the support means during use, but preferably, the screen members are simply dislodged from the screen by the object moving the screen members and the screen members settling into the screen position once the object has passed.

It is preferred that either the upper or the lower end of each of the screen members is held more securely to the support means than the opposite end of the screen members. This preferably forms a flap member of the screen member so that the object can dislodge the screen's less secured end from the screen or support means. When the upper end is more securely attached than the lower end, the flap will be dislodged and then usually realign itself with the screen for continued use, whereas when the lower end of the screen member is more securely attached than the upper end, the upper end with be disengaged and fall under the influence of gravity to let the object pass through an opening so formed. For example, the less securely attached end of each screen member may be provided with a number of spaced apart Velcro® fastening portions and a more or less continuous strip at the more securely attached end. Magnetic fastening means may be used at a lower end to assist with the realignment of the screen once the object has passed.

It is also preferred that the attachment means of the invention is located on the side of the screen which faces the trainee when the screen is erected as this will provide a substantially one-way screen. However, screen members may be erected with the attachment means located on either side of the screen and in some embodiments there may be combinations of first and second side attachment means. In a third embodiment, the attachment members may be located toward the midline of the support members as this may provide two-directional capability without requiring the attachment means to be located on either side of the screen.

There may be primary attachment means located at the upper and/or lower ends of the screen members and secondary attachment means at the sides, if required. In fact, attachment means may be provided only at the upper end if required. Alternatively, the attachment means may be provided on at least one of the sides of the screen member.

The screen formed by collocation of a number of screen members may be associated with the support means through the use of a pivoting mounting frame, adapted to be substantially vertical in use and be mounted for pivoting about a central axis. This may allow the pivoting screen and the screen members to swing back and forth as used and self-locate themselves once dislodged from their set position by the passing of an object. The pivoting screen may be provided with biasing means such as springs for example to assist with the self location of the screen. The screen members may abut one another, partially overlap each other, or for development screens, be spaced from one another.

The erection of the screen may form a screen which has the appearance of a continuous screen but is in fact, formed of a number of cells of each of the screen members.

The screen can be erected having any configuration to assist the sport in relation to which the apparatus is being used. For example, for soccer training or hockey training, the screen may be erected in front of a goal mouth and spaced from the goal mouth for the training of the goal keeper. Balls can them be propelled toward the goal through the screen at the goal, and the goal keeper can attempt to stop them. For rugby training, a pair of parallel screens may be used to define a channel through which a player can run and pass to either side of themselves to support players running on the opposite side of the channel. For tennis, the screen can be used above the net of a conventional court and the ball served or hit through the screen.

The object used to propel through the screen will generally be a ball or similar piece of sports equipment. However, it is to be appreciated that the object may be a person, to simulate a tackling drill for example. Different sports will have different objects that can be used and it is to be noted that the object des not have to be a ball or similar.

The inventor of the present invention is aware that the object will typically deviate in path after striking the screen but this may be used to further complicate the training drill for the trainee. The deviation of the object when passing the screen will preferably be minimised. Further, the difficulty level may be adjusted by placing the screen closer to the trainee so that the time for reaction is decreased as the trainee becomes more adept at using the apparatus.

The apparatus of the present invention is designed to avoid "folding" about the object as this may impede the progress of the object. The screen is not to be limited to any size or dimension. It is preferably lightweight to provide portability and will preferably be substantially unaffected by weather conditions.

The apparatus can be used from a single screen or a plurality of screens can be used to construct a "wall". In this instance, individual apparatus may be butted together or marginally overlapped with each other to provide the wall. Alternatively, a series of screens can be staggered or separated to provide partial visibility to allow progressive development of a player by closing the openings.

Where the initial development of a player is concerned, the screens will generally not be butted against each other, adjoining each other or overlapping to produce the low visibility situation. In these situations, the screens will generally be separated to allow for the gradual development of the player's reaction time. The separation of the screens will be gradually closed as they progress.

The screen members are also ideally suited to have advertising or sponsorship details located thereon. Other printing may be used such as targets or similar to increase accuracy.

Typically, the screen will be used in a fixed location but it is anticipated that moving drills can be developed using a screen mounted for movement. The screen apparatus may be retro-fit to existing apparatus such as goal posts or similar and appropriate mounting means will be used in these circumstances.

Another important feature of the present invention is in the minimisation of disruption of the screen under the influence of wind or similar A wind screen may be provided to be placed in between the screen assembly and the direction of the prevailing wind or more complex devices can be provided. One example of a more complex device is the provision of a catch system to hold the screen members in place and release them as the object approaches. This can be accomplished using an optic or light trigger such that as an object approaches the screen it is detected by disruption of a light beams of sheet which triggers the release of the catch holding the screen members.

Another additional feature which may be included in the invention is the provision of a return means to minimise the displacement of the screen members. If the object impacts the screen members with sufficient force, the screen members may be moved to a position such as over the top of the support means, such that it cannot fall back into place. A return means may be provided to minimise this occurrence. The return means may be a moving mechanism to return the screen members to their use position or it may be as simple as a bar or net preventing the screen members from moving into a problematic position.

BRIEF DESCRIPTION OF THE DRAWINGS

Various embodiments of the invention will be described with reference to the following drawings, in which:

FIG. 10 is a front elevation view of a screen formed from screen members as illustrated in FIG. 7, and will a pivoting screen arrangement.

FIGS. 10A to 10D show the screen of FIG. 10 in operation.

DETAILED DESCRIPTION OF THE PREFERRED EMBODIMENT

According to the preferred embodiment of the present invention, a screen apparatus for use in sports training or sports skills development is provided.

Figure 2:
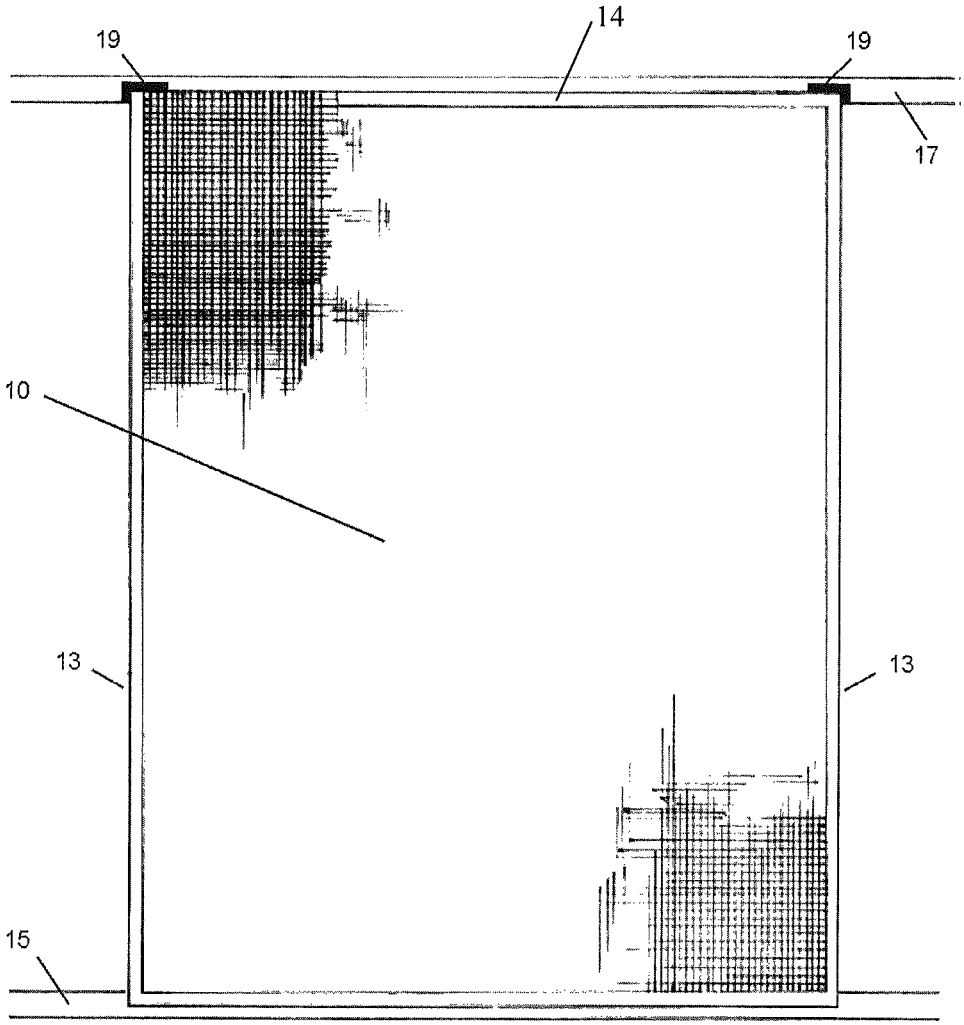
FIG. 2 is a front elevation view of a panel in the screen apparatus according to a preferred embodiment of the invention.
Figure 3:
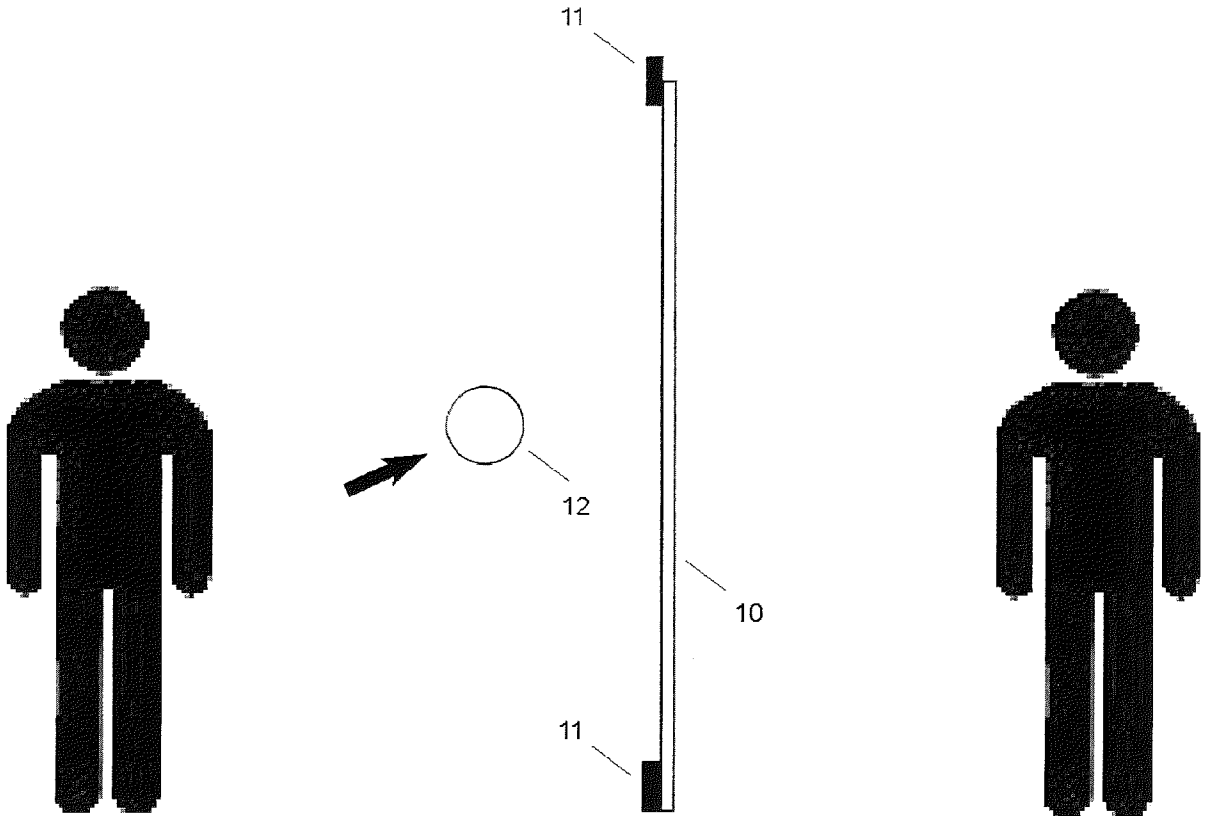
FIG. 3 is a schematic sectional side view of a preferred embodiment of the invention showing its function.

The screen apparatus as illustrated in FIGS. 2 and 3 particularly, includes a plurality of screen members 10, one of which is illustrated in FIG. 2, and support members 11 for supporting the screen members 10 in a use condition. Each of the screen members 10 is at least temporarily attached relative to the support members such that in use, the screen members 10 define a screen, as illustrated in FIG. 3, until struck by an object 12 at which time at least one of the screen members 10 is at least partially dislodged from the screen to allow passage of the object 12 in a substantially uninhibited manner.

Each of the screen members 10 are manufactured from a light material so as not to disrupt or only minimally disrupt the passage of the object 12 through the screen as seen in FIG. 1.

According to the preferred form, the screen member 10 is a mesh member stretched across a frame. The frame of the preferred embodiment is rectangular as illustrated in FIG. 2, as this will allow a more geometrical arrangement with a large number of configurations for the screen. The frame includes a pair of side members 13, a top member 14 and a bottom member 15, each of which are elongate members and the mesh is tightly stretched across the support frame.

The mesh will preferably be tightly meshed with openings approximately 1 mm on a side. The openings are defined by members extending in a first direction and other members extending in a second direction, normally substantially perpendicularly.

The mesh member of the preferred embodiment is formed of plastic and is what is conventionally termed "shade cloth".

The mesh makes up the major surface area of each of the screen members 10 and due to its configuration, will provide the limited visibility intended from the apparatus. The limited visibility can be increased through the provision of a backing screen located behind the trainer.

Each screen member 10 is approximately 0.3 m by 0.3 m but may be of any size depending on the size of the object being used to train the player.

The support means of the preferred embodiment illustrated in the Figures, includes a pair laterally extending members 11. The support members of the preferred embodiment are rigid and manufactured from light but strong materials such as plastic. The support members 11 used according to the preferred embodiment are modular so it can be packed into a small bag or similar for transport and quickly erected to form a size-adjustable screen.

Both the support members 11 and the screen members 10 are provided with a portion of an attachment means to temporarily attach the screen members 10 relative to the support members 11 to form the screen. According to the preferred embodiment, the attachment means 19 is a hook and eye fastener such as Velcro® with a portion on the support means 11 and the corresponding portion of the fastener on each screen member 10, or on one or more of the frame members.

According to the preferred embodiment, the lower end of each of the screen members 10 is held more securely to the lower support member 16 than the upper end of the screen member 10. This forms a flap member out of the screen member 10 so that the object 12 can dislodge the screen member's 10 upper end from the upper support member and can fall under the influence of gravity to let the object 12 pass through the opening so formed. For example, the upper end of each screen member 10 is provided with a number of spaced apart Velcro fastening portions and a more or less continuous strip of Velcro® is used at the lower end.

It is also preferred that the attachment means 19 of the invention are located on the side of the screen which faces the trainee when the screen is erected, as illustrated in the Figures.

The screen can be erected having any configuration to assist the sport in relation to which the apparatus is being used. For example, for soccer training or hockey training, the screen may be erected in front of a goal mouth and spaced from the goal mouth for the training of the goal keeper. Balls can then be propelled toward the goal through the screen at the goal, and the goal keeper can attempt to stop them. For rugby training, a pair of parallel screens may be used to define a channel through which a player can run and pass to either side of themselves to support players running on the opposite side of the channel. For tennis, the screen can be used above the net of a conventional court and the ball served or hit through the screen.

The method of use and the operation of the apparatus of the preferred embodiment is illustrated in FIGS. 1A to 1E.

Figures 1A, 1B, 1C, 1D, 1E:
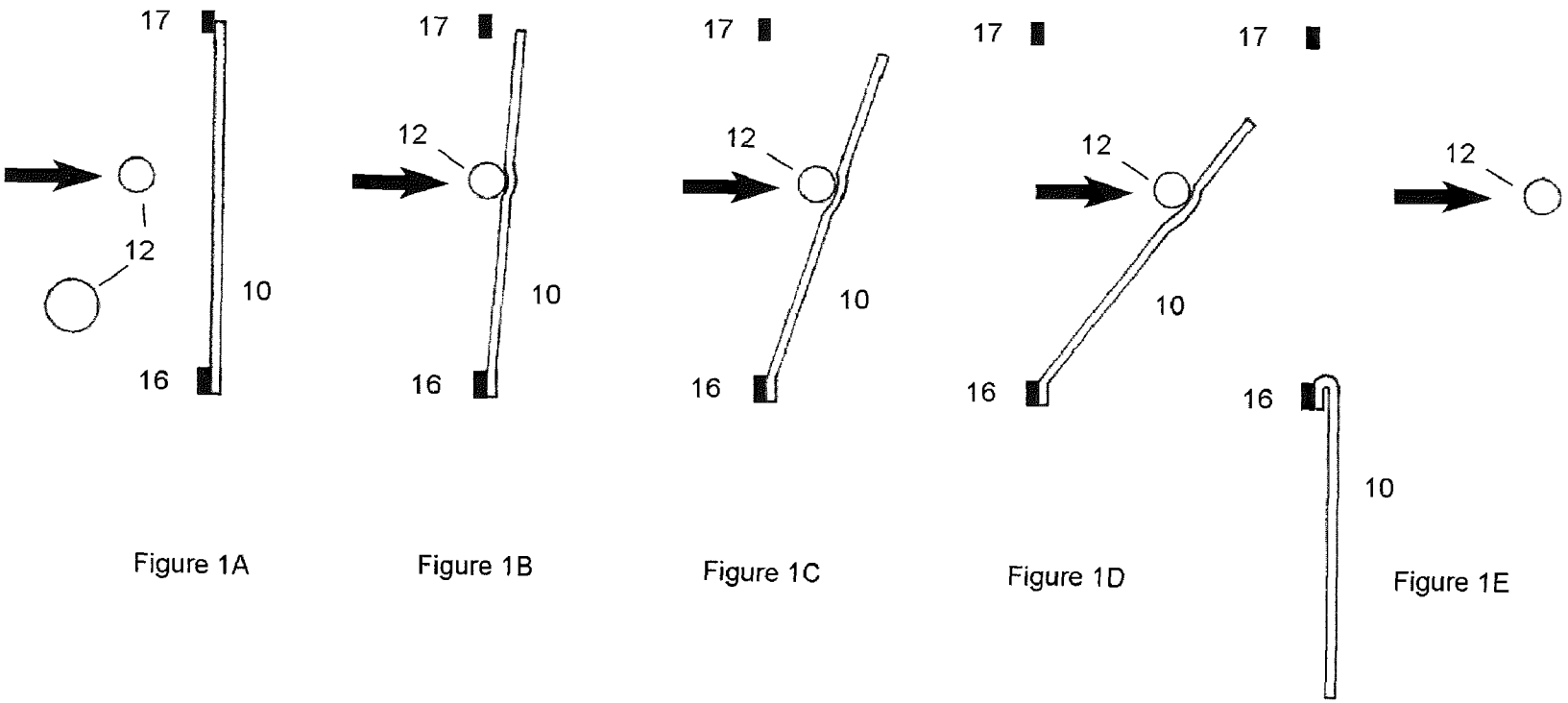
FIGS. 1A to 1E is a series of sectional side views illustrating the steps involved in the use of a screen apparatus according to an embodiment of the present invention.

In FIG. 1A, the object 12 is seen approaching the screen of the preferred embodiment by being kicked or struck towards the screen. At this stage, the trainee either cannot see the object or has only limited vision of the object 12. In FIG. 1B, the object 12 has struck the screen member 10. The apparatus of the present invention is designed to avoid "folding" about the object. The upper end of the screen member has been dislodged from the upper support member 17 and the screen begins to fall. The screen is also pushed out of the way by the momentum of the object 12 and continues to move creating an opening as seen in FIGS. 1C and 1D to allow the object 12 to pass through the screen. Note the small size of the object 12 when compared to the size of the screen, meaning that it is likely that only a single screen member 10 has been dislodged. In FIG. 1E, the screen member which is flexible, has fallen being retained attached to the lower support member 16 and the object has passed the screen and continues on its path.

Figure 4:
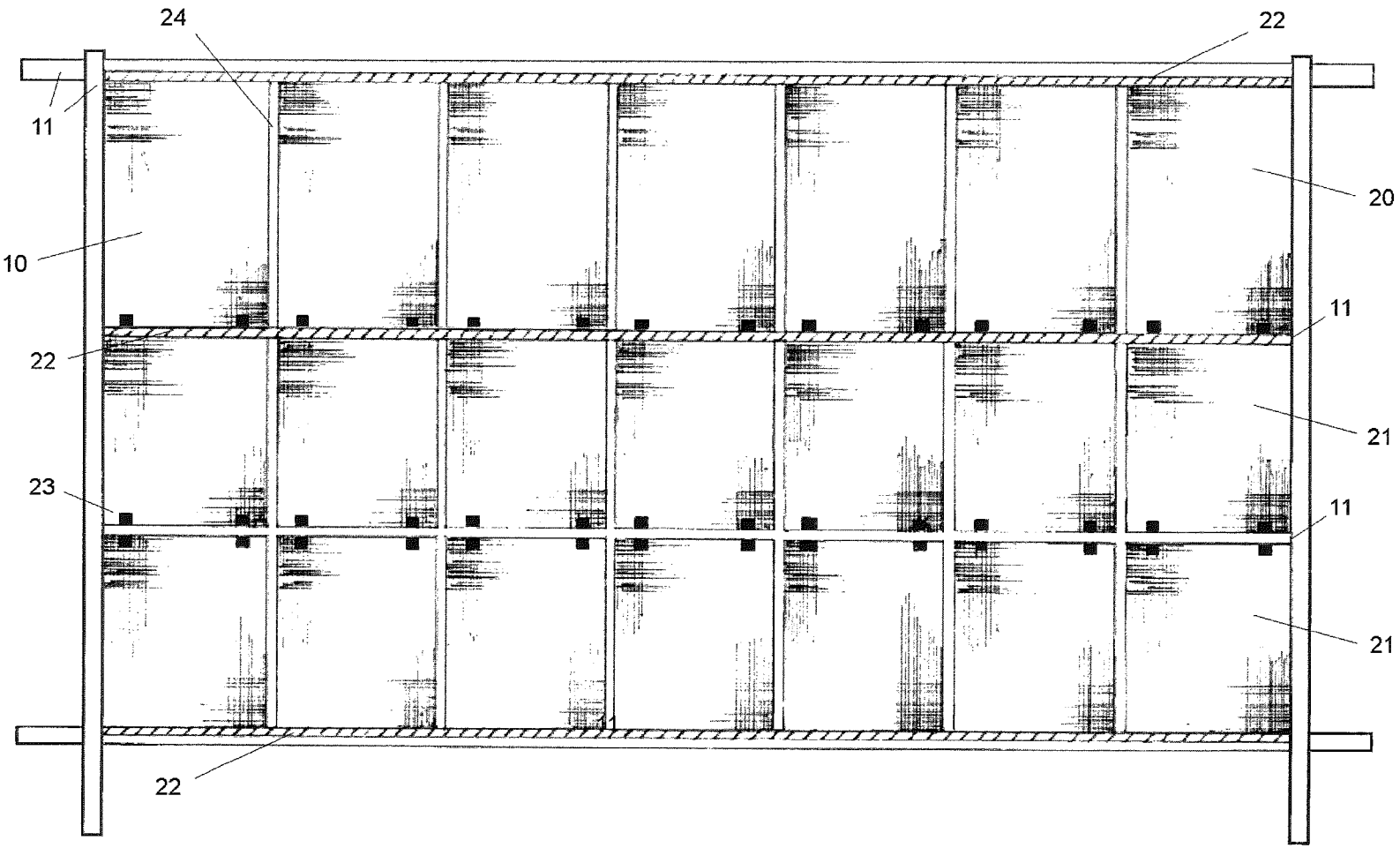
FIG. 4 is a front view of a screen formed according to a preferred embodiment of the present invention.

The screen illustrated in FIG. 4 has functional features that may be less apparent from FIGS. 1 to 3, such as the upper screen members 20 being larger than the lower screen members 21. The screen in FIG. 4 also has the lower screen members 21 more securely attached to the support members 11 at the lower end with an attachment strip 22 with the upper end of this row being attached using spaced apart Velcro tabs 23. The upper and middle rows of screen members are more securely attached to the support members 11 at the upper end with an attachment strip 22 with the upper end of this row being attached using spaced apart Velcro® tabs 23. The screen members are also overlapped 24 in the screen illustrated in FIG. 4 to minimise the visibility offered to the trainee.

Figure 5:
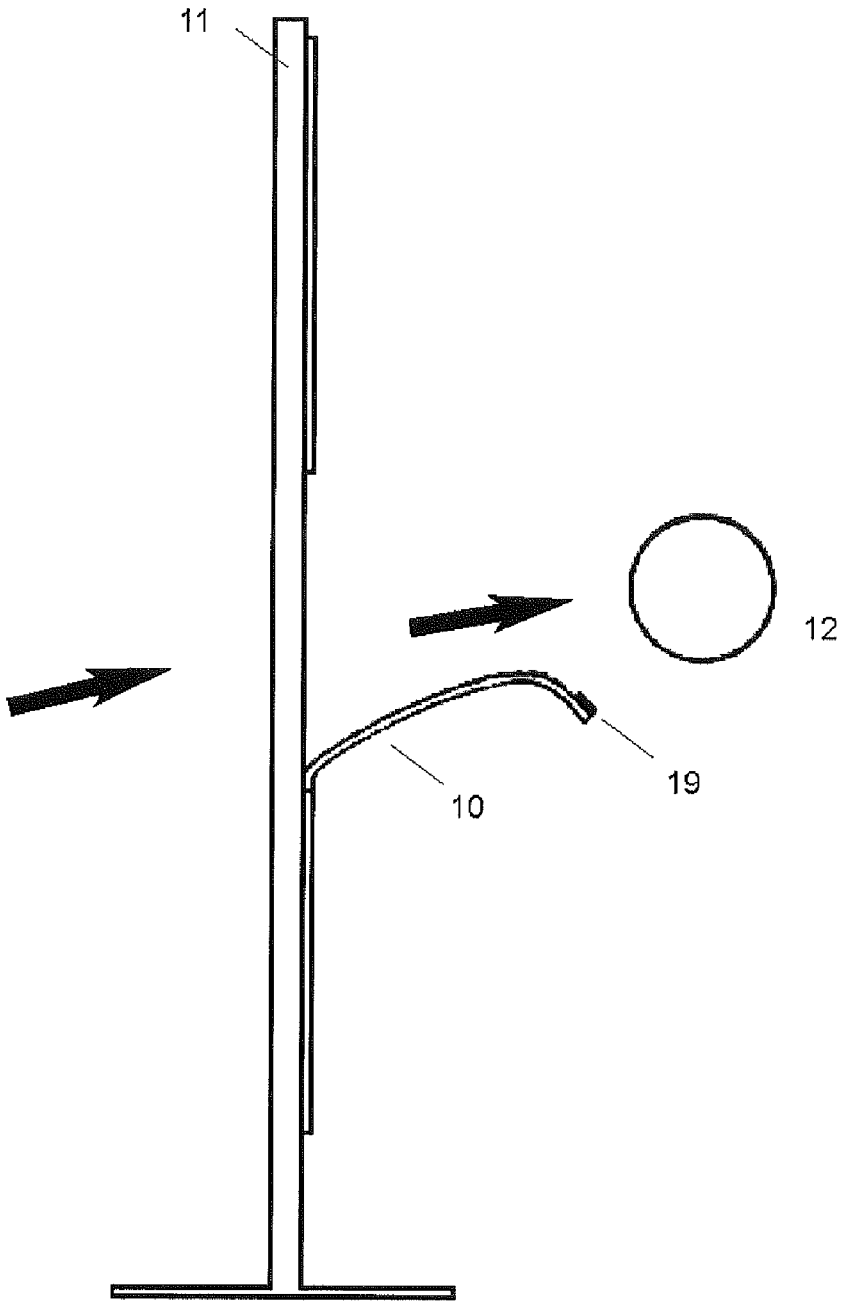
FIG. 5 is a schematic sectional side elevation illustrating the function of the screen illustrated in FIG. 4 with a secure lower attachment means when an object strikes it.

FIG. 5 illustrates the object 12 as it travels through the screen illustrated in FIG. 4, as seen from the side. The object 12 strikes the central screen member 10 which is more securely attached at the lower end than the top. The object dislodges the screen member 10 from its attachment at the upper end and the screen member 10 falls, creating an opening through which the object 12 passes and continues on its path. The adjacent screen members 10 are not dislodged.

Figure 6:
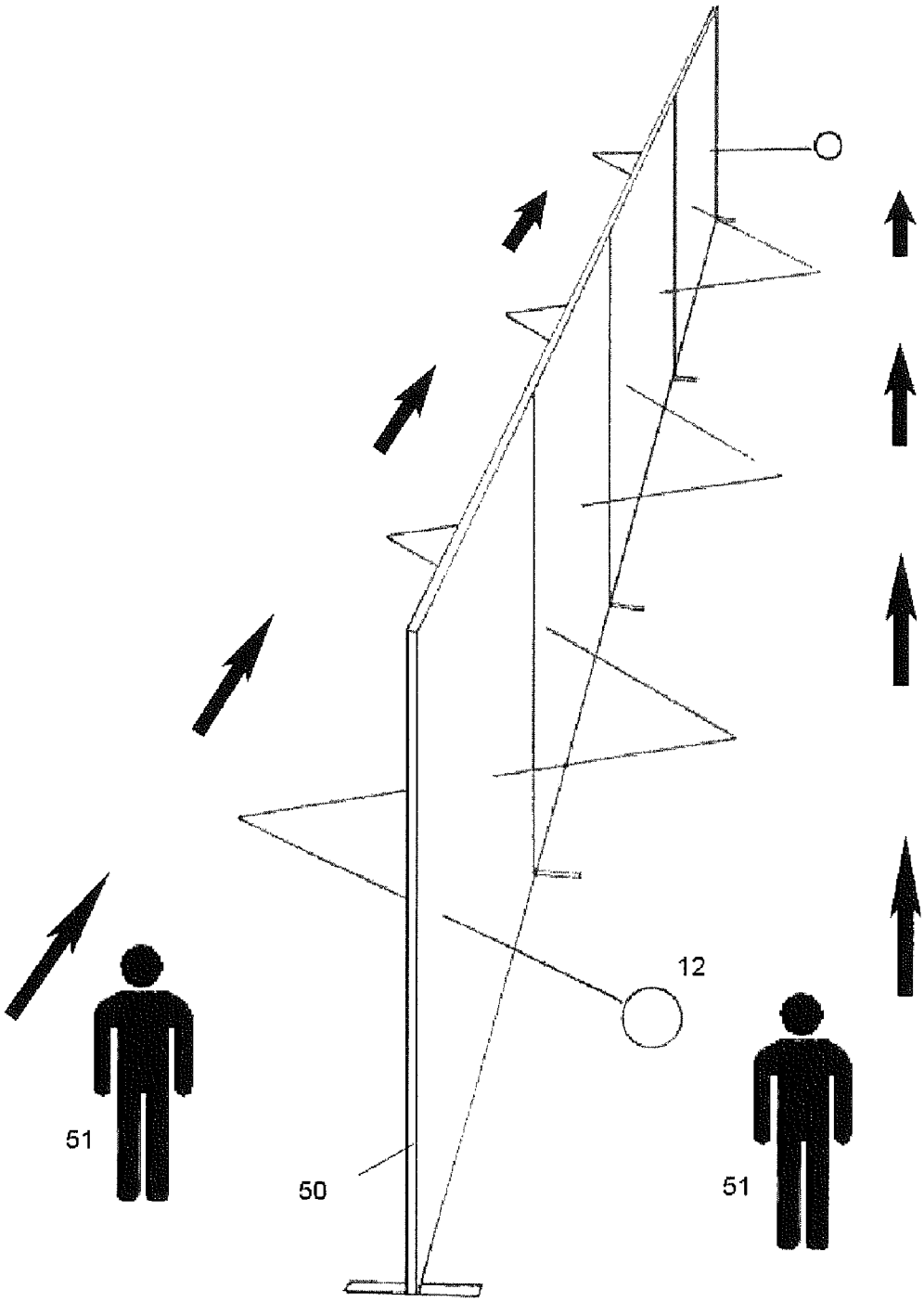
FIG. 6 is a schematic view of one possible use of a screen apparatus according to the present invention.

FIG. 6 illustrates one example of use of the screen 50 of the present invention. The trainees 51 run in lines substantially parallel to the screen in the direction of the arrows, and pass the object 12, in this case a ball, back and forth through the screen.

Figure 7:
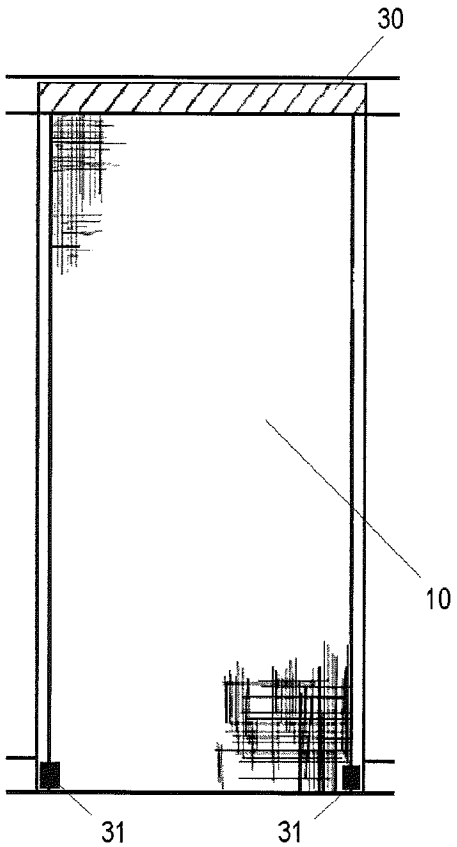
FIG. 7 is a front elevation view of another preferred embodiment of the screen member according to the present invention.

FIG. 7 shows a further preferred embodiment of the screen member 10 with a strip of attachment Velcro® 30 at the upper end of the screen member 10 and a pair of magnetic attachment means 31 located one at either lower corner of the screen member 10. Corresponding magnetic attachment means 32 are provided on the support members 11 to engage with the screen member magnetic attachment means.

Figure 8:
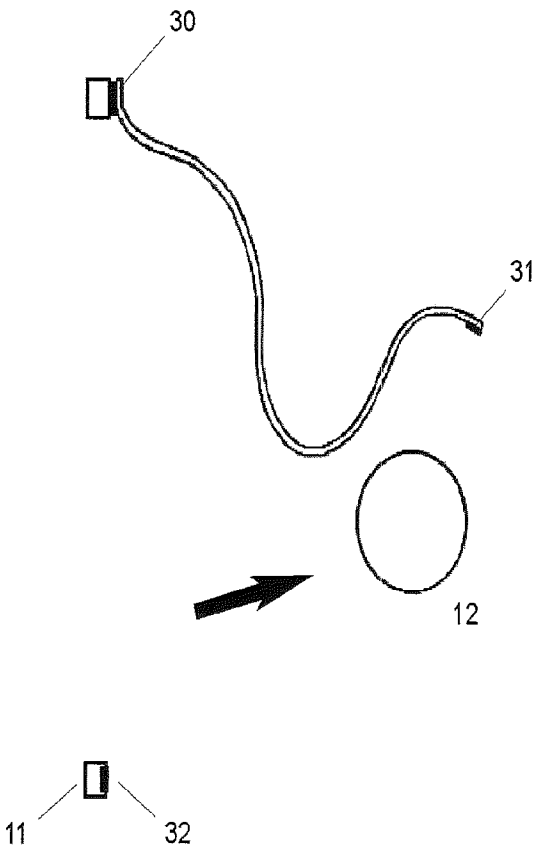
FIG. 8 is a sectional side view showing the use of the screen member illustrated in FIG. 7.

The screen of FIG. 7 is illustrated in use in FIG. 8. As can be seen, as the object 12 strikes the screen member, the pair of magnetic attachment means 31 located one at the lower end of the screen member 10 are dislodged from the corresponding magnetic attachment means 2 provided on the support members 11 and the screen member 10 is deflected upwardly about the fixed attachment Velcro® 30 at the upper end of the screen member 10. As the screen member 10 falls back down, the magnetic attachments will self-locate the screen member 10 ready for next use.

Figure 9:
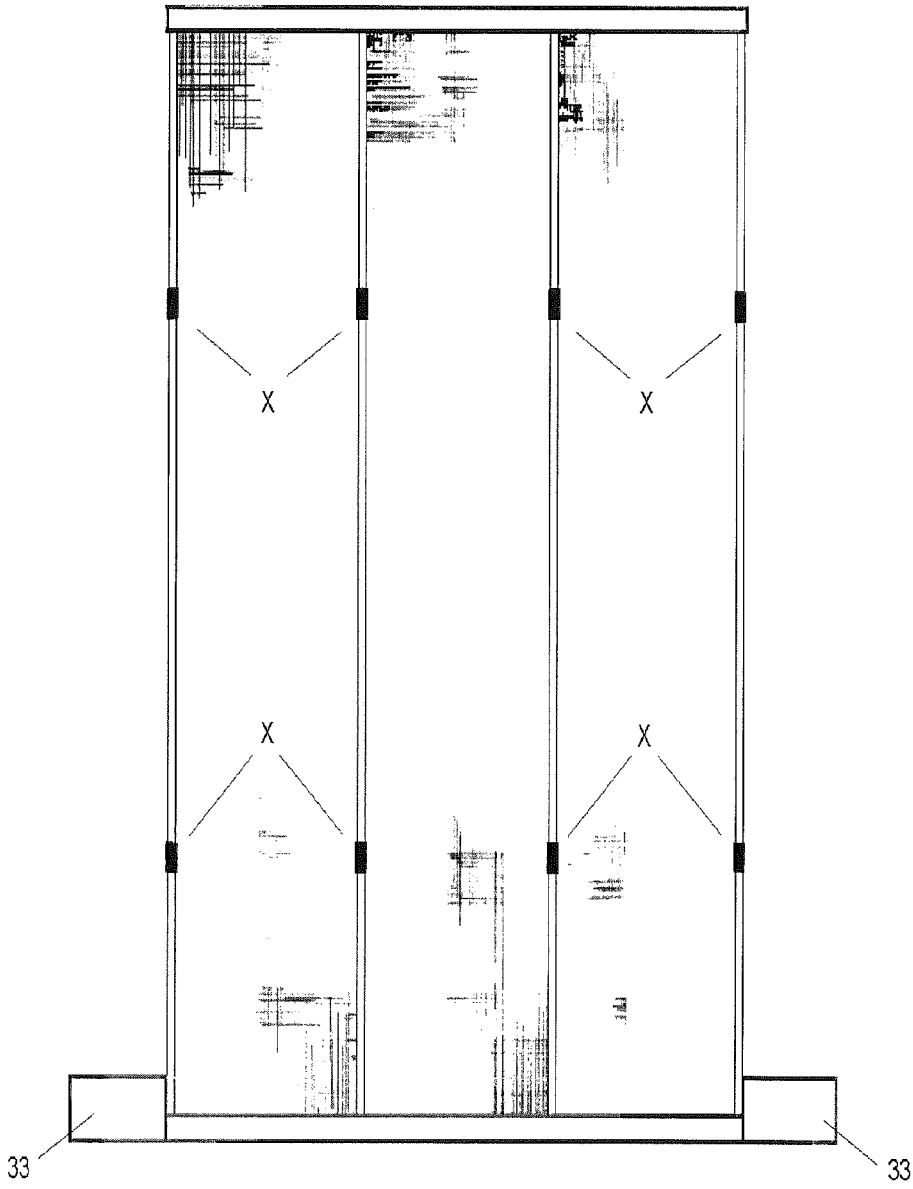
FIG. 9 is a front elevation view of an embodiment of the screen with attachment means at the sides of the screen member.

The screen illustrated in FIG. 9 has attachment means provided at the sides of the screen members, as illustrated by the "X". The support means of this embodiment also has ground engaging members 33 which are sand filled to add to stability.

The screen of the embodiment illustrated in FIG. 10 is formed by collocation of a number of screen members 10 and the screen is associated with a support frame 35 through the use of a pivoting screen mounting frame 36, adapted to be substantially vertical in use and mounted for pivoting about a pair of opposed central pivot points 37. The screen members 10 are fixed to the pivoting screen mounting frame 36 at the top of the screen members and set in the substantially vertical use condition as illustrated in FIG. 10A.

As illustrated in FIGS. 10A to 10D, this allows the pivoting screen mounting frame 36 to swing forwardly (FIG. 10B) and then backwardly (FIG. 10C) as used, deflected by the impetus of the object 12 as it passes through the screen and the screen members 10 self-locate themselves once dislodged from their set position by the passing of the object 12 as the pivoting screen mounting frame swings backwardly (FIG. 10C). The pivoting screen mounting frame 36 is provided with biasing means, in this embodiment springs 38, to assist with the self location of the screen. Both the screen members 10 and the pivoting screen mounting frame 36 self-locate ready for next use, as illustrated in FIG. 10D.

Figure 11:
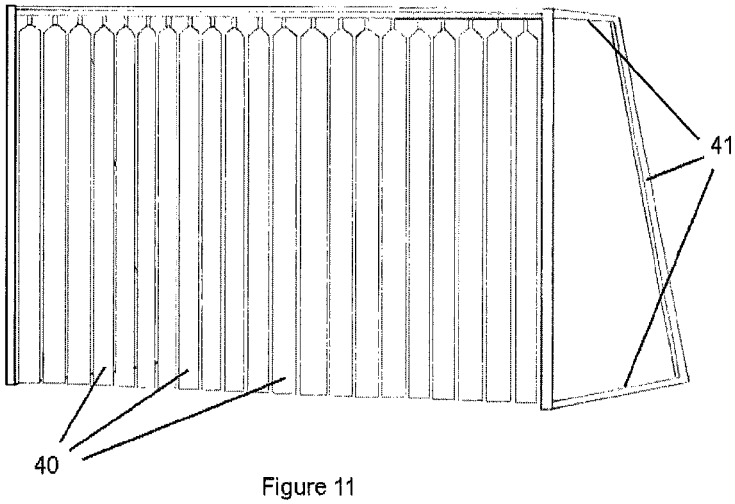
FIG. 11 is a front elevation view of a further embodiment of the present invention in the ribbon screen member configuration.
Figure 12:
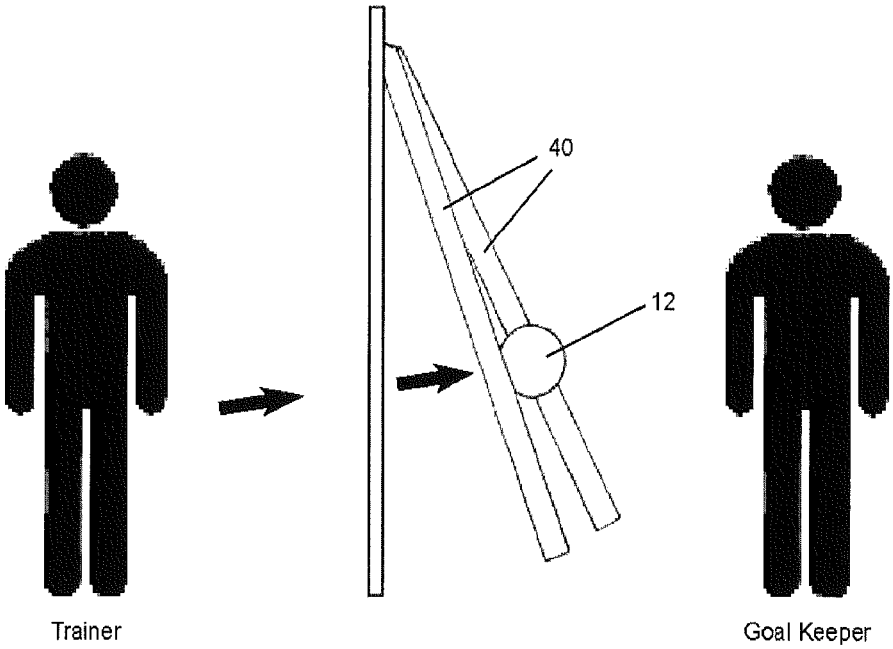
FIG. 12 is a sectional side view of the embodiment illustrated in FIG. 11 in operation.
Figures 13A, 13B, 13C, 13D:
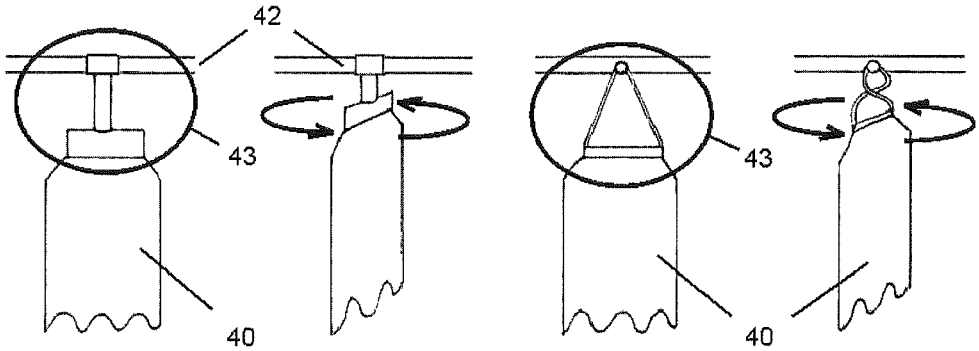
FIGS. 13A to 13D are front elevation views of the operation of swivel action attachments for the ribbon screen members.

A further embodiment of the invention is illustrated in FIGS. 11 and 12, namely the ribbon screen. The screen includes a support frame holding a plurality of ribbon screen members 40 in a vertical orientation. The top rail 42 of the support frame is maintained in position by one or more leg members 41 and the ribbon members 40 hang from the top rail 42 under the influence of gravity. As seen in FIG. 12, as the object 12 passes the screen, one or more of the ribbon screen members 40 are pushed out of the way to allow the object 12 to pass after which the ribbon members 40 re-orient themselves due to gravity. The ribbon members 40 are attached to the top rail 42 using the preferred swivel attachments 43 illustrated in FIG. 13.

Figure 14:
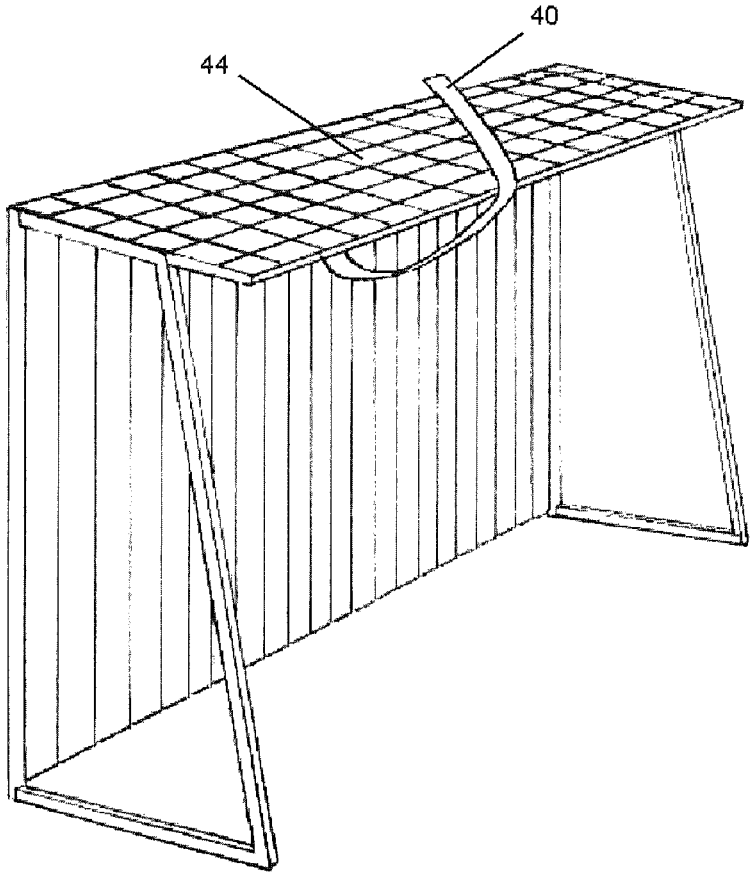
FIG. 14 is a perspective view of the embodiment illustrated in FIG. 11 with the return means in use.

The operation of a return means in the form of a net member 44 to minimise the displacement of the ribbon members 40 is illustrated in FIG. 14. If the object 12 impacts the ribbon members 40 with sufficient force, the ribbon members 40 may be moved to a position such as over the top of the support means, such that it cannot fall back into place, as illustrated. A return means, such as the net 22 illustrated may be provided to minimise this occurrence.

FIGS. 15A to 15E are front elevation views of a blank, scalloped ribbon, a low vision ribbon, a fringed ribbon, a blank ribbon and weighted ribbons respectively. The different ribbon members are used in different situations to allow the difficulty of the use of the screen to be adjusted for users of different levels.

Figures 15A, 15B, 15C, 15D, 15E:
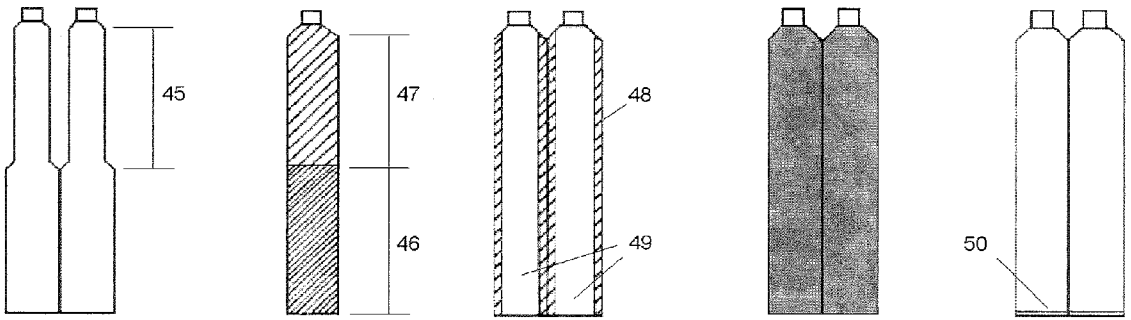
FIGS. 15A to 15E are front elevation views of a blank, scalloped ribbon, a low vision ribbon, a fringed ribbon, a blank ribbon and weighted ribbons respectively.

For example, the scalloped edges 45 of the ribbon 40 illustrated in FIG. 15A allow partial clear vision through the screen through the gaps created. The ribbon illustrated in FIG. 15B has a nil-vision lower portion 46 and a low visibility upper portion 47. The ribbon illustrated in FIG. 15C has a low visibility upper portion 48 provided on either lateral side of a central nil-vision portion 49 and the screen illustrated in FIG. 15D is completely nil-vision. Each ribbon illustrated in FIG. 15E has a weight 50 provided at a lower end to assist with minimising the effects of wind or to provide a small obstruction when moving the ribbon.

Figures 16A, 16B, 16C, 16D, 16E:
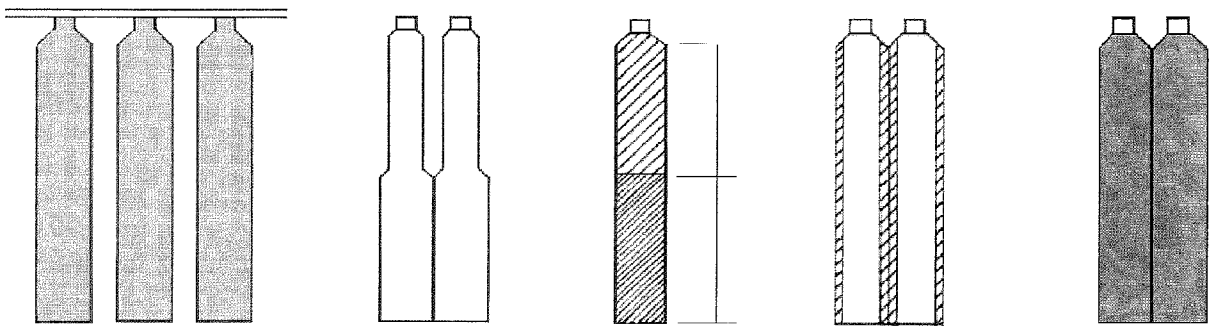
FIGS. 16A to 16E illustrate the methodology of the incremental difficulty of the screens.

The graduation from the spaced screen illustrated in FIG. 16A to the blank screens of FIG. 16E increases the difficulty in using the screen by progressively restricting the view of objects on the far side of the screen. Normally, beginner users will start using screens of FIG. 16A or 16B and increase difficulty as they become more proficient. The less difficult screens may also be used for children.

In the present specification and claims (if any), the word "comprising" and its derivatives including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

The invention claimed is:

1. A screen apparatus for use in sports training or sports skills development, the screen apparatus comprising:

a plurality of ribbon screen members; and a support disposed to support the screen members in a use condition;

wherein each of the screen members is at least temporarily attached suspended relative to the support utilizing a suspension assembly including a portion attached to the support and a dependent portion pivotally attached thereto, the suspension assembly allowing swivel rotation of each ribbon screen member and biased into an orientation that whereby a width of the ribbon screen member is presented to a user;

wherein the screen members define a screen disposed between a trainee and an object, the screen configured to obscure vision of the object by the trainee;

wherein the screen is further configured such that when struck by the object at least one of the screen members is at least partially dislodged to allow passage of the object in a substantially uninhibited manner, whereby the previously obscured object is rendered visible to the trainee such that the trainee has a reduced time to react to the object.

2. A method for sports training or sports skills development, comprising:

locating the screen apparatus of claim 1 between a trainee and an object to decrease the visibility of the object by the trainee and;

propelling the object through the screen apparatus to simulate a sports situation such that the trainee has less time to react to the object.

3. A screen apparatus according to claim 1, wherein each of the screen members are manufactured from a lightweight material so as to only minimally disrupt the passage of the object through the screen.

4. A screen apparatus according to claim 1, wherein the screen member includes at least mesh portion.

5. A screen apparatus according to claim 1, wherein the screen member is totally opaque.

6. A screen apparatus according to claim 1, wherein each screen member includes a surround frame with a flexible screen member supported by the surround frame.

7. A screen apparatus according to claim 1, including a plurality of screen members suspended in a substantially coplanar orientation thereby forms a screen.

8. A screen apparatus according to claim 1, wherein each screen member has at least one less wide portion extending at least partially over its length in order to provide a small amount of visibility through the screen.

9. A screen apparatus according to claim 1, wherein the support includes temporary fixers configured to temporarily fix the screen members in a use condition, the support including one or more ground bearing members with one or more uprights and laterally extending members.

10. A screen apparatus according to claim 1, wherein the support means used is modular and capable of disassembly for transport and storage.

11. A screen apparatus according to claim 1, wherein at least one screen member is at least partially dislodged from the support means during use.

12. A screen apparatus according to claim 1, wherein at least one screen member is dislodged from the screen by the object moving the screen members and the screen members settling into the screen position once the object has passed.

13. A screen apparatus according to claim 12, wherein magnetic fastening means are used at a lower end of at least some of the screen members to assist with the realignment of the screen once the object has passed.

14. A screen apparatus according to claim 1, wherein the screen members abut one another to form the screen.

15. A screen apparatus according to claim 1, wherein the screen members partially overlap each other to form the screen.

16. A screen apparatus according to claim 1, wherein the screen members are spaced from one another.

17. A screen apparatus according to claim 1, wherein the screen members have printing thereon.

18. A screen apparatus according to claim 1, wherein the screen apparatus is mobile during use.

19. A screen apparatus according to claim 1, further including a wind screen to be placed in between the screen assembly and the direction of the prevailing wind.

20. A screen apparatus according to claim 1, further including a catch system to hold the screen members in place and release them as the object approaches.

21. A screen apparatus according to claim 1, further includes a return mechanism to minimize the displacement of the screen members and to assist with the return of the screen members to their use position.

22. A screen apparatus according to claim 1, wherein the screen formed has one-way visibility.

23. A screen apparatus according to claim 1, wherein the screen formed has no visibility from both sides.

* * * * *